US012336620B2

(12) United States Patent
Tong

(10) Patent No.: US 12,336,620 B2
(45) Date of Patent: Jun. 24, 2025

(54) ACCESSORY ATTACHMENT ARRANGEMENT FOR A WEARABLE PACK

(71) Applicant: Eberlestock USA LLC, Boise, ID (US)

(72) Inventor: Nathaniel C. B. Tong, Boise, ID (US)

(73) Assignee: Eberlestock USA LLC, Boise, ID (US)

( * ) Notice: Subject to any disclaimer, the term of this patent is extended or adjusted under 35 U.S.C. 154(b) by 241 days.

(21) Appl. No.: 17/840,308

(22) Filed: Jun. 14, 2022

(65) Prior Publication Data

US 2023/0397709 A1 Dec. 14, 2023

(51) Int. Cl.
*A45F 3/08* (2006.01)
*A45F 3/00* (2006.01)
*A45F 3/14* (2006.01)

(52) U.S. Cl.
CPC ..... *A45F 3/08* (2013.01); *A45F 3/14* (2013.01); *A45F 2003/003* (2013.01); *A45F 2003/146* (2013.01)

(58) Field of Classification Search
CPC ..... A45F 3/08; A45F 3/14
USPC ..... 224/646, 183
See application file for complete search history.

(56) References Cited

U.S. PATENT DOCUMENTS 4,497,069 A * 2/1985 Braunhut ..... F41H 1/02 2/2.5
4,907,729 A * 3/1990 Hess, III ..... A45C 1/04 224/675
5,201,448 A * 4/1993 Schue ..... B25H 3/00 224/660
5,240,156 A * 8/1993 Sicotte ..... A41F 9/002 224/583
5,263,618 A * 11/1993 Talavera ..... A45F 3/14 224/605
5,465,425 A * 11/1995 Crispin ..... A41D 13/0012 2/108
5,470,000 A * 11/1995 Munoz ..... B25H 3/00 224/660
5,505,356 A * 4/1996 Noriega ..... A41D 13/0012 2/338
5,570,824 A * 11/1996 Lyon ..... A45F 5/021 224/678
5,693,006 A * 12/1997 Slautterback ..... A61F 5/028 224/675
5,743,447 A * 4/1998 McDermott ..... A45C 7/0086 224/583
D420,792 S * 2/2000 Sakelliou ..... D3/217
6,108,816 A * 8/2000 Bradley ..... A62B 99/00 2/102

(Continued)

FOREIGN PATENT DOCUMENTS

KR 10-2380551 A 3/2022

OTHER PUBLICATIONS

Extended European Search Report Dated Oct. 26, 2023 for European Patent Application No. 23155562.4 (9 pages).

*Primary Examiner* — Nathan J Newhouse
*Assistant Examiner* — Lester L Vanterpool
(74) *Attorney, Agent, or Firm* — TAYLOR & EDELSTEIN, PC

(57) ABSTRACT

A wearable pack system includes: a support device; and a pack device coupled with the support device, the pack device including an accessory attachment arrangement including a hook panel and a loop panel which together are configured for selectively coupling with a hook and loop mechanism of at least one accessory device.

8 Claims, 10 Drawing Sheets

(56) References Cited

U.S. PATENT DOCUMENTS 6,152,338 A 11/2000 Smith
6,279,804 B1 * 8/2001 Gregg ..... A45F 5/02 224/675
6,610,032 B1 * 8/2003 Prody ..... A61M 27/00 604/179
6,691,906 B2 * 2/2004 Cragg ..... F41C 33/046 224/236
D487,189 S * 3/2004 Ukitsu ..... D3/217
D500,590 S * 1/2005 Sachen ..... D3/216
6,932,256 B2 * 8/2005 Hale ..... A45F 3/042 224/648
7,047,570 B2 * 5/2006 Johnson ..... F41H 1/02 2/102
7,124,921 B1 * 10/2006 Hubbell ..... A45F 3/16 224/652
7,770,770 B2 * 8/2010 Murdoch ..... F41C 33/04 224/675
7,987,523 B2 * 8/2011 Cole ..... F41H 1/02 2/102
8,032,951 B1 * 10/2011 Nestberg ..... A41D 27/20 2/69
8,132,669 B1 3/2012 Stubel
8,231,816 B2 * 7/2012 Kingsford ..... A61F 13/06 264/254
8,720,681 B1 * 5/2014 Hancock ..... A45C 13/1069 224/183
9,872,553 B1 * 1/2018 Erlandson ..... A45F 3/00
9,993,039 B2 * 6/2018 Nykoluk ..... A41D 13/0562
10,045,626 B1 * 8/2018 Cheetham ..... A47C 7/546
10,051,948 B2 * 8/2018 Carver ..... A45F 5/021
10,871,351 B2 * 12/2020 Becker ..... F41H 1/02
11,284,691 B2 * 3/2022 Rosen ..... A45C 15/00
2011/0094006 A1 * 4/2011 Cole ..... F41H 1/02 2/102
2011/0231976 A1 9/2011 Herbener et al.
2012/0024924 A1 2/2012 Hexels
2013/0068804 A1 * 3/2013 Tweedie ..... A45F 3/02 224/148.1
2015/0068933 A1 * 3/2015 So ..... A45C 11/38 150/112
2016/0128394 A1 5/2016 Kohrman
2020/0300582 A1 * 9/2020 Becker ..... A41D 13/0012
2021/0015228 A1 * 1/2021 Burns ..... A45F 3/14
2021/0045470 A1 2/2021 Martinez
2021/0345759 A1 * 11/2021 Racicot ..... A45F 3/047

* cited by examiner

ACCESSORY ATTACHMENT ARRANGEMENT FOR A WEARABLE PACK

BACKGROUND OF THE INVENTION

1. Field of the Invention

The present invention relates to wearable packs, and, more particularly, to structure for attaching accessory devices to the wearable pack.

2. Description of the Related Art

Wearable packs come in a variety of forms. For example, wearable packs can be in the form of backpacks, chest packs, and fanny packs. Chest packs, for example, can be used as part of a chest pack and harness system, which is typically used in outdoor settings and can include a harness device and a chest pack device. The harness device includes straps which extend over the shoulders of a user and couple with the chest pack device at opposing ends of the straps, so that the shoulders of the user bear the weight of the chest pack device. The chest pack device can be any kind of pack that is configured for carrying one or more items therein and that, when the chest pack and harness system is worn by the user, is positioned on or about the chest of the user. For example, the chest pack device can be a binocular chest pack device, configured for carrying binoculars therein. A problem exists, however, with being able to attach and to remove, securely and conveniently, accessory devices to wearable packs, such as chest pack devices.

What is needed in the art is an improved way of attaching accessory devices to the wearable pack.

SUMMARY OF THE INVENTION

The present invention provides a wearable pack system including a pack device including an accessory attachment arrangement with hook and loop fastener panels configured for selectively coupling with at least one accessory device, so as to attach the at least one accessory device to the pack device.

The invention in one form is directed to a wearable pack system includes: a support device; and a pack device coupled with the support device, the pack device including an accessory attachment arrangement including a hook panel and a loop panel which together are configured for selectively coupling with a hook and loop mechanism of at least one accessory device.

The invention in another form is directed to a pack device of a wearable pack system including a support device, the pack device being coupled with the support device, the pack device including: a pack device coupled with the support device, the pack device including an accessory attachment arrangement including a hook panel and a loop panel which together are configured for selectively coupling with a hook and loop mechanism of at least one accessory device.

The invention in another form is directed to a method of using a wearable pack system, the method including the steps of: providing the wearable pack system including a support device and a pack device coupled with the support device, the pack device including an accessory attachment arrangement including a hook panel and a loop panel; and coupling selectively the hook panel and the loop panel together with a hook and loop mechanism of at least one accessory device.

An advantage of the present invention is that it provides a simple, quick, and efficient way to attach, and detach, accessory devices to a wearable pack, namely by way of the hook and loop fastener panels.

Another advantage is that the hook and loop panels of the accessory attachment arrangement and of the accessory devices are not visible, while the accessory devices hang lower than the pack device.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
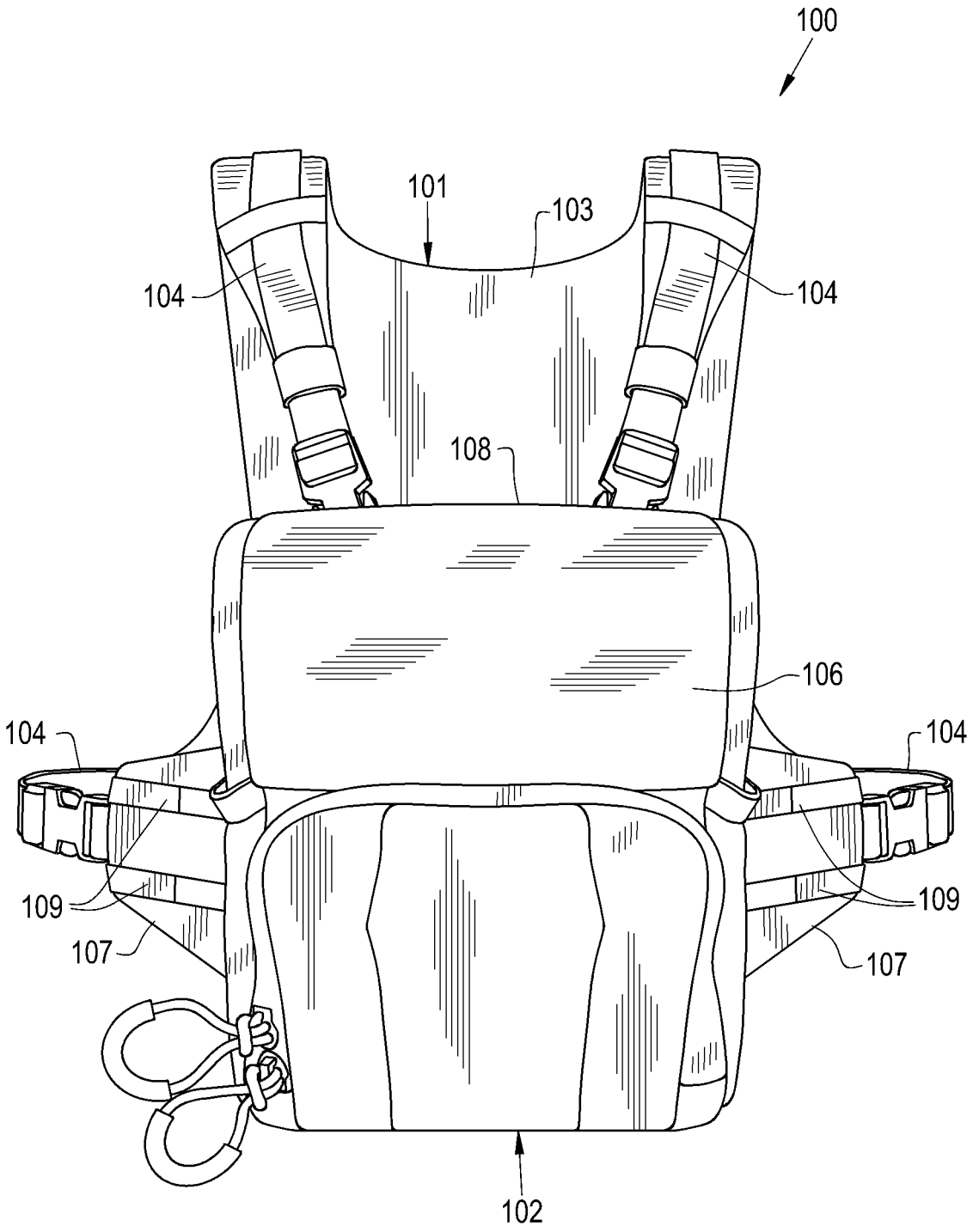
FIG. 1 is a front view of an exemplary embodiment of a wearable pack system, which includes a harness device and a chest pack device, in accordance with an exemplary embodiment of the present invention.

Referring now to the drawings, and more particularly to FIG. 1, there is shown a wearable pack system 100, which generally includes a support device 101 and a pack device 102 coupled with support device 101. Support device 101 is any suitable device configured for supporting and thereby for securing pack device 102 to something else, such as a body of a human being who is wearing pack system 100. In one embodiment of support device 101, support device 101 can be a harness device 101 (which can be referred to as harness 101), as shown in FIG. 1. Harness 101 can include a rear panel 103, a plurality of adjustable straps 104 coupled with rear panel 103, and a plurality of buckles 205 (which can also be referred to as a ladder-lock device)(see FIG. 2) coupling respective ones of straps 104 together and which allow straps 104 to be adjusted in terms of their relative length for user comfort. Further, as shown in FIG. 1, straps 104 can be removably attached to pack device 102 by way of clips. During use, rear panel 103 is configured for being positioned at or near an upper back of a user, such that the user's head and neck extend between front straps 104 (in the foreground of FIG. 1), which lie over the user's shoulders or trapezius muscles, which at least in part bear the weight of pack device 102.

Figure 6:
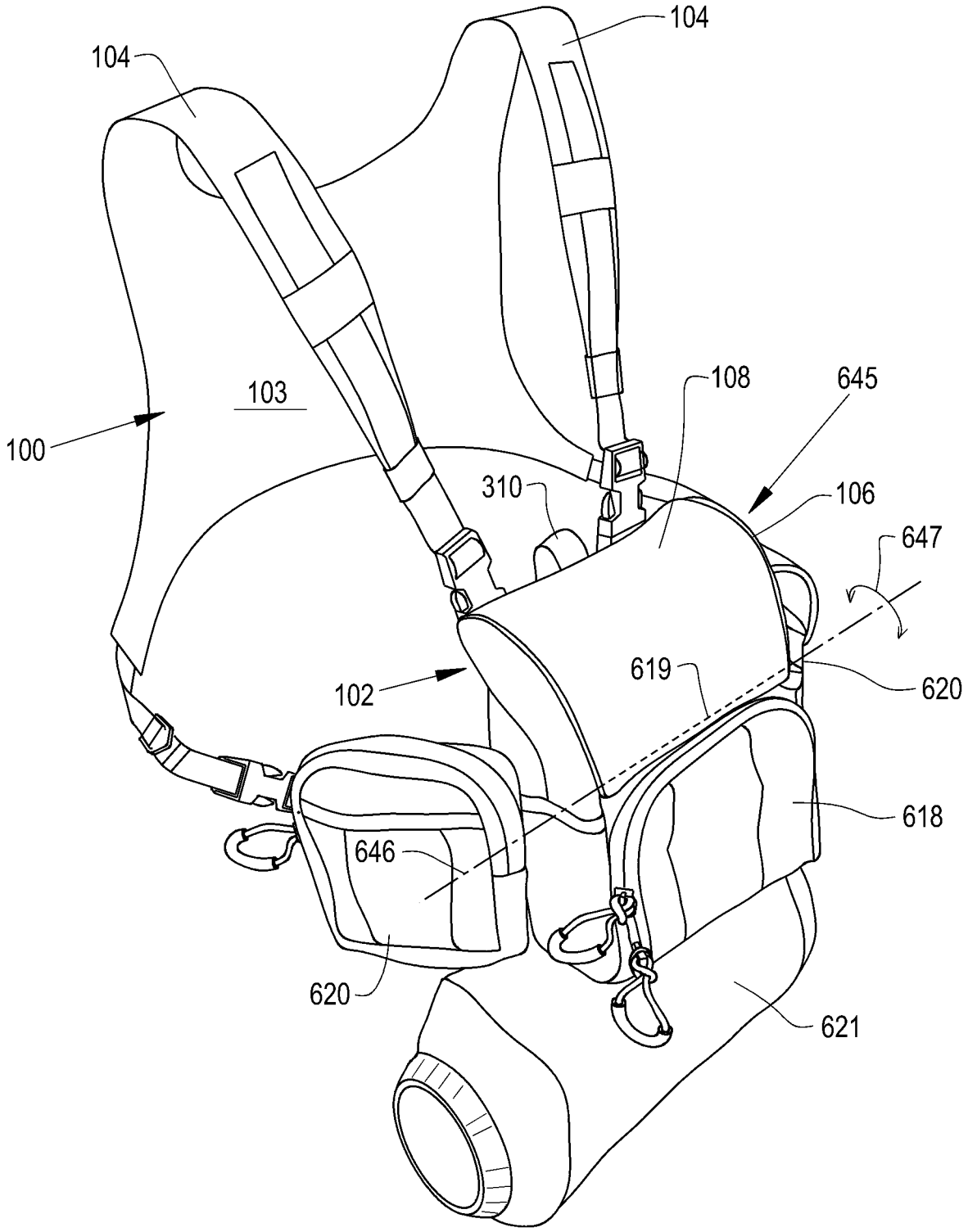
FIG. 6 is a front perspective view of another exemplary embodiment of the wearable pack system of FIG. 1, the wearable pack system including the harness device, the chest pack device, side pouches, and a handwarmer device, in accordance with an exemplary embodiment of the present invention.

Pack device 102 includes a central pack 106 and side extensions 107 attached to either lateral side of central pack 106. Pack device 102 can any suitable device configured for carrying any item within a cavity 733 (FIG. 7) of pack device 102, such as a cavity 733 defined by central pack 106. For instance, pack device 102 can be a fanny pack or a chest pack. As discussed herein, pack device 102, according to one embodiment of the present invention, is assumed to be a chest pack 102, such that central pack 106 is configured for being positioned at or near a user's chest when pack device 102 is being worn by a user. Further, the cavity 733 of central pack 106 is configured for removably receiving, storing, or otherwise carrying therein any suitably sized object. Such an object can be, for example, a pair of binoculars (not shown), and thus chest pack device 102 can be more specifically referred to as a binocular chest pack device 102 (or, alternatively, as pack 102, chest pack 102, binocular pack 102, or bino pack 102), as discussed herein, according to an embodiment of the present invention. Central pack 106 can include a top closure 108 (which can be referred to as lid 108) which folds forward (away from user's chest) about a fabric hinge 619 (FIG. 6) in order to open lid 108 and thereby to expose the cavity 733 therein. Side extensions 107 can be integrally attached to central pack 106 at least partially wraps around the user's body and further serves as a way to attach accessory devices, such as side pouches 620 (FIG. 6). Accordingly, side extensions 107 can each include an attachment structure 109 for attaching such side pouches 620; such attachment structures 109 can be, for example, a respective MOLLE panel (that is, a Modular Lightweight Load-carrying Equipment panel), configured for receiving straps of side pouches 620 therein so as to securely attach side pouches 620 to structures 109.

Figure 2:
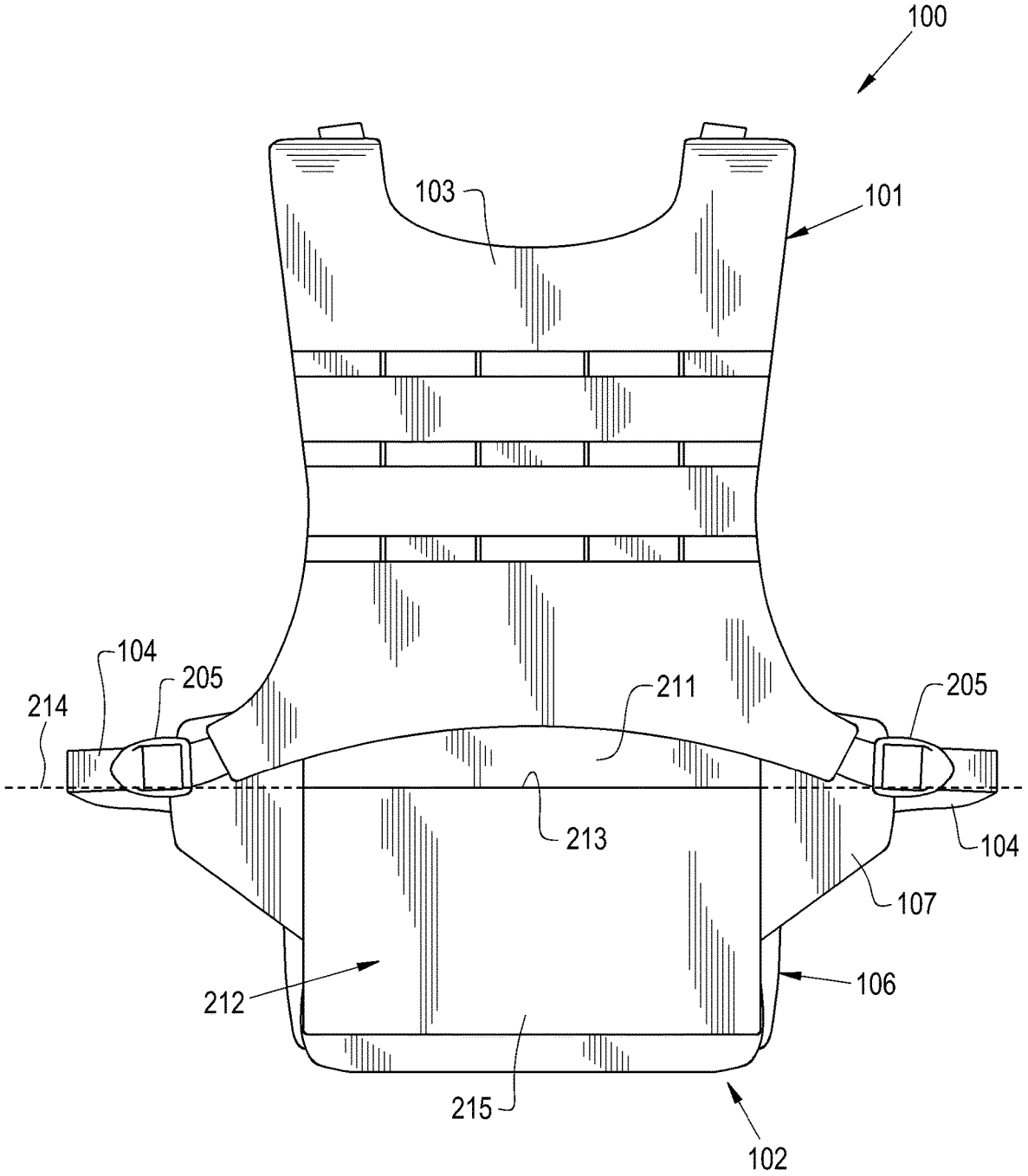
FIG. 2 is rear view of the wearable pack system of FIG. 1.
Figure 8:
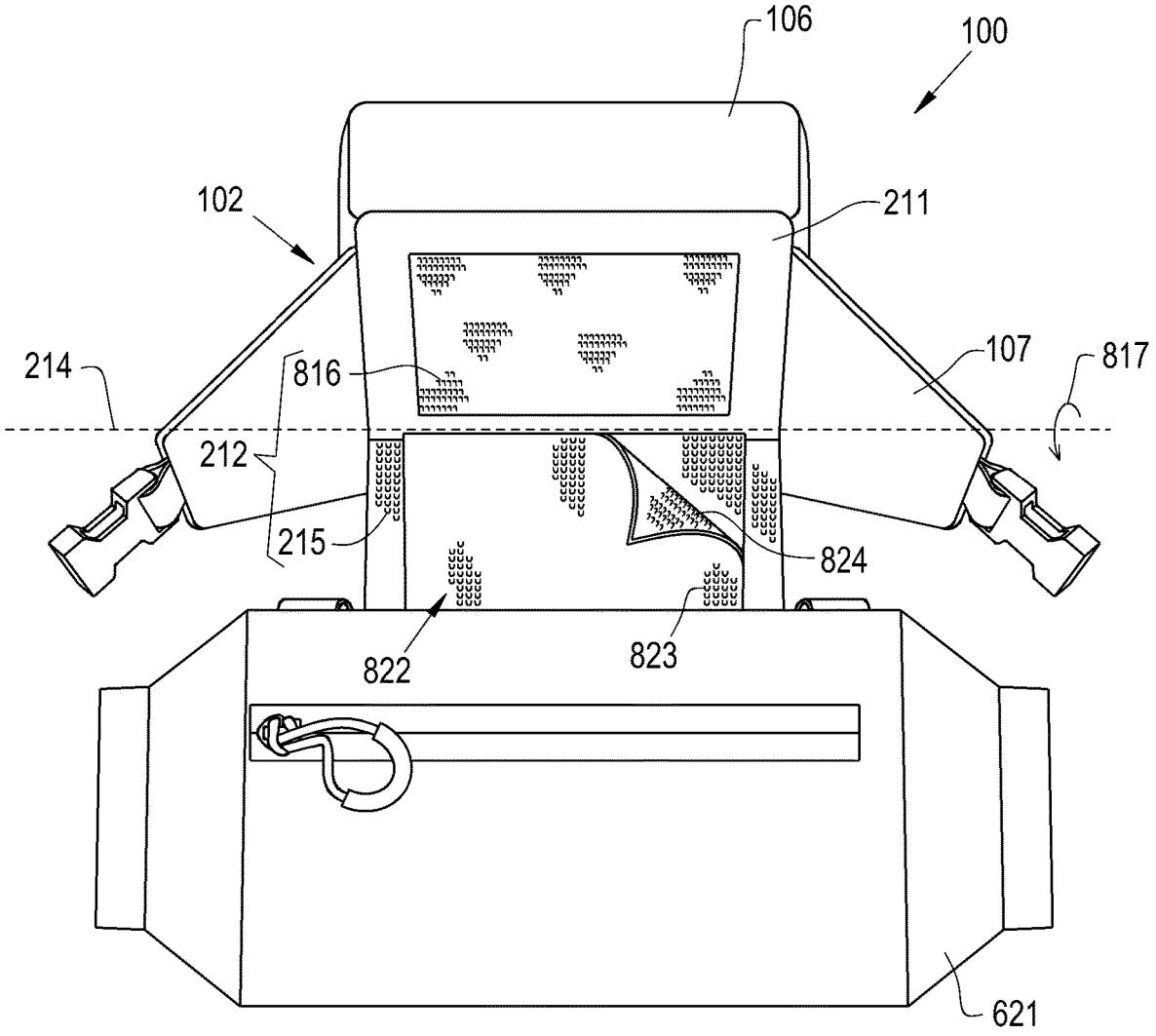
FIG. 8 is a rear perspective view of the wearable pack system 100 of FIG. 7, with the chest pack device rotated 180° relative to FIG. 7, in accordance with an exemplary embodiment of the present invention.

Referring now to FIG. 2, there is shown a rear view of system 100. Central pack 106 of chest pack device 102 includes a rear side 211 (opposing the front side shown in FIG. 1) and an accessory attachment arrangement 212. Arrangement 212 is shown in FIG. 2 to include a flap 215 attached to rear side 211, such as by way of a fabric hinge 213 (which can be formed by a linear seam for example), through which extends an axis of rotation 214, about which a free portion of flap 215 can pivot. In this way, flap 215 is pivotal relative to rear side 211 (FIG. 8).

Figure 3:
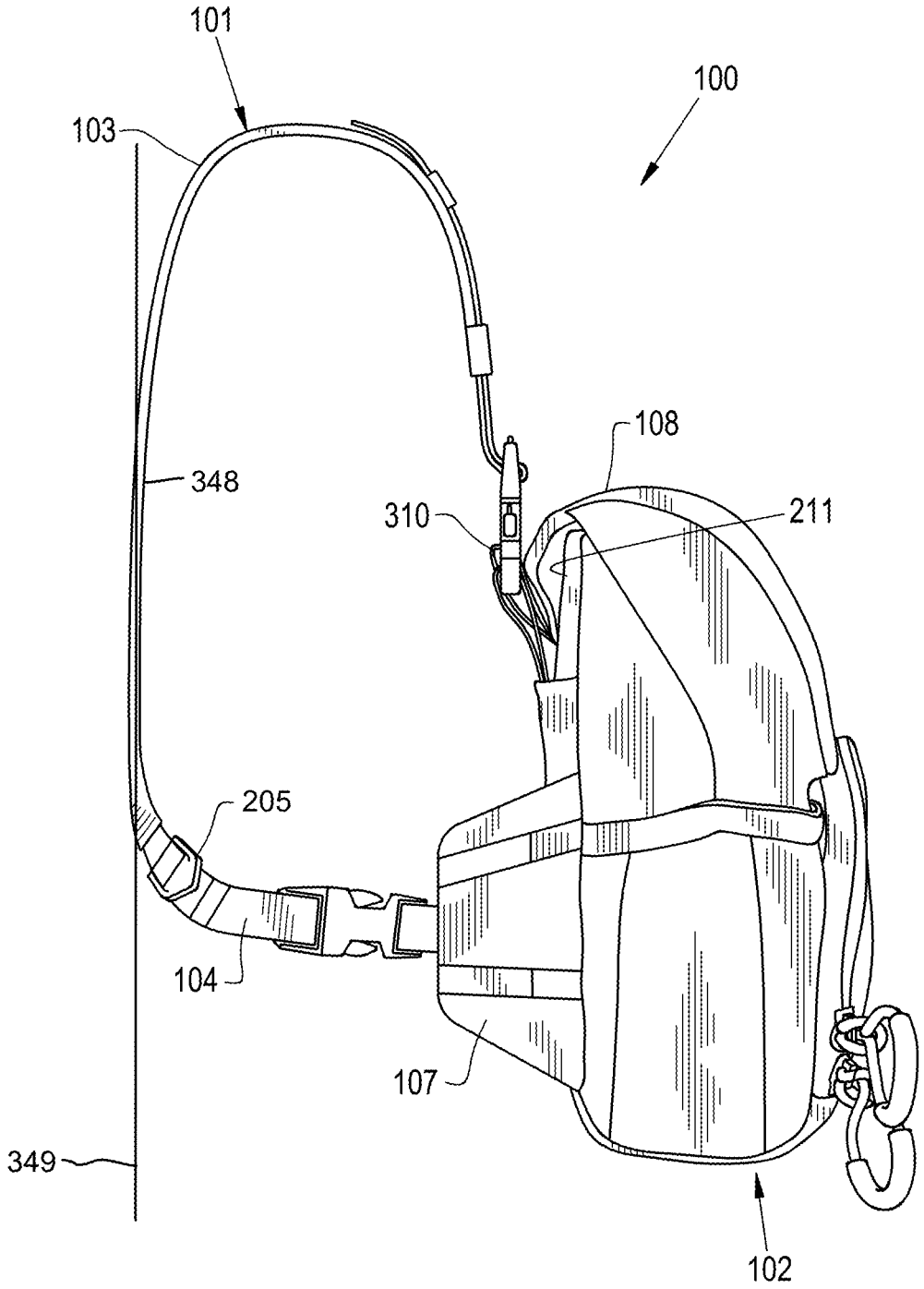
FIG. 3 is a side view of the wearable pack system of FIG. 1, the other side being substantially similar thereto.

Referring now to FIG. 3, there is shown a left side view of system 100 (that is, the left side of the view of FIG. 1). Central pack 106 is shown to include lid 106, which further includes a lift tab 310, by which a user can grasp and pull lid 108 forward in order to expose the cavity 733 of central pack 106. Harness 101 includes a rear portion 348. Hook panel 816 or loop panel 215 is pivotal relative to rear side 211 from a closed position by pivoting rearwardly toward a vertical plane 349 associated with rear portion 348 of harness 101.

Figure 4:
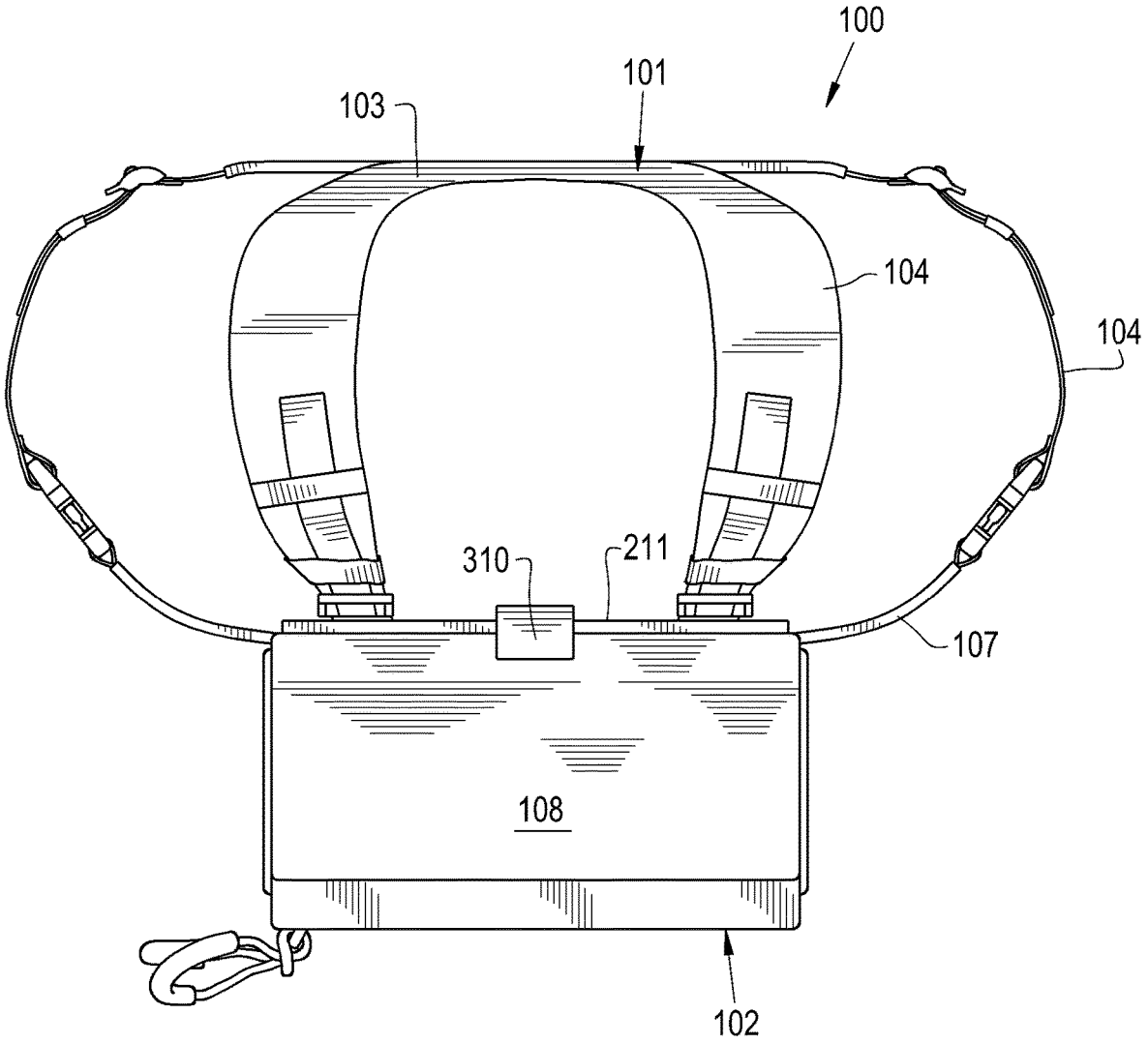
FIG. 4 is a top view of the wearable pack system of FIG. 1.
Figure 5:
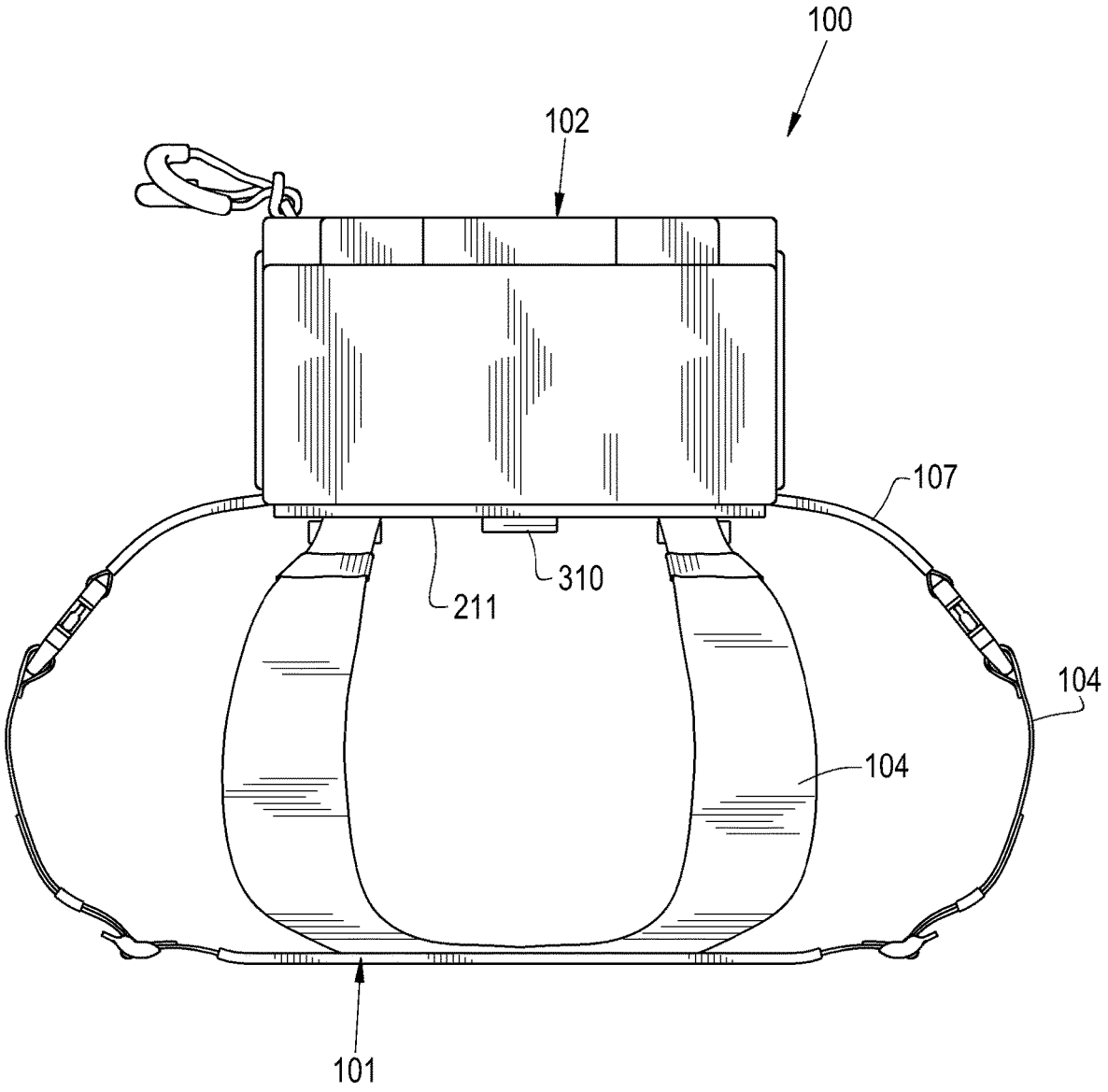
FIG. 5 is a bottom view of the wearable pack system of FIG. 1.

FIGS. 4-5 show additional views (top and bottom views respectively) of pack system 100 of FIG. 1.

Referring now to FIG. 6, there is shown a front perspective view of wearable pack system 100, according to another exemplary embodiment of the present invention. Wearable pack system 100 includes harness device 101 and binocular chest pack device 102 as described above, but FIG. 6 shows that system 100 can further include a plurality of accessory devices, such as two side pouches 620 and a handwarmer device 621. Side pouches 620 attach to respective side extensions 107, such as by way of straps of side pouches 620 coupling with MOLLE panels 109 of respective side extensions 107. Handwarmer device 621 (which can be referred to herein as handwarmer 621) can include opposing openings, through which a user can insert one's hands in order to warm the hands. Handwarmer device 621 is coupled with accessory attachment arrangement 212 of central pack 106, as described more fully below. Further, central pack 106 includes a front side 618. Front side 618 includes a fabric hinge 619 by way of which the lid 108 is configured for pivoting—about an axis of rotation 646 defined by fabric hinge 619—between an open position 744 (FIG. 7) and a closed position 645, as indicated by double-arrow 647. Lid can define a portion of front side 618 and a portion of rear side 211, when lid 108 is in closed position 645.

Figure 7:
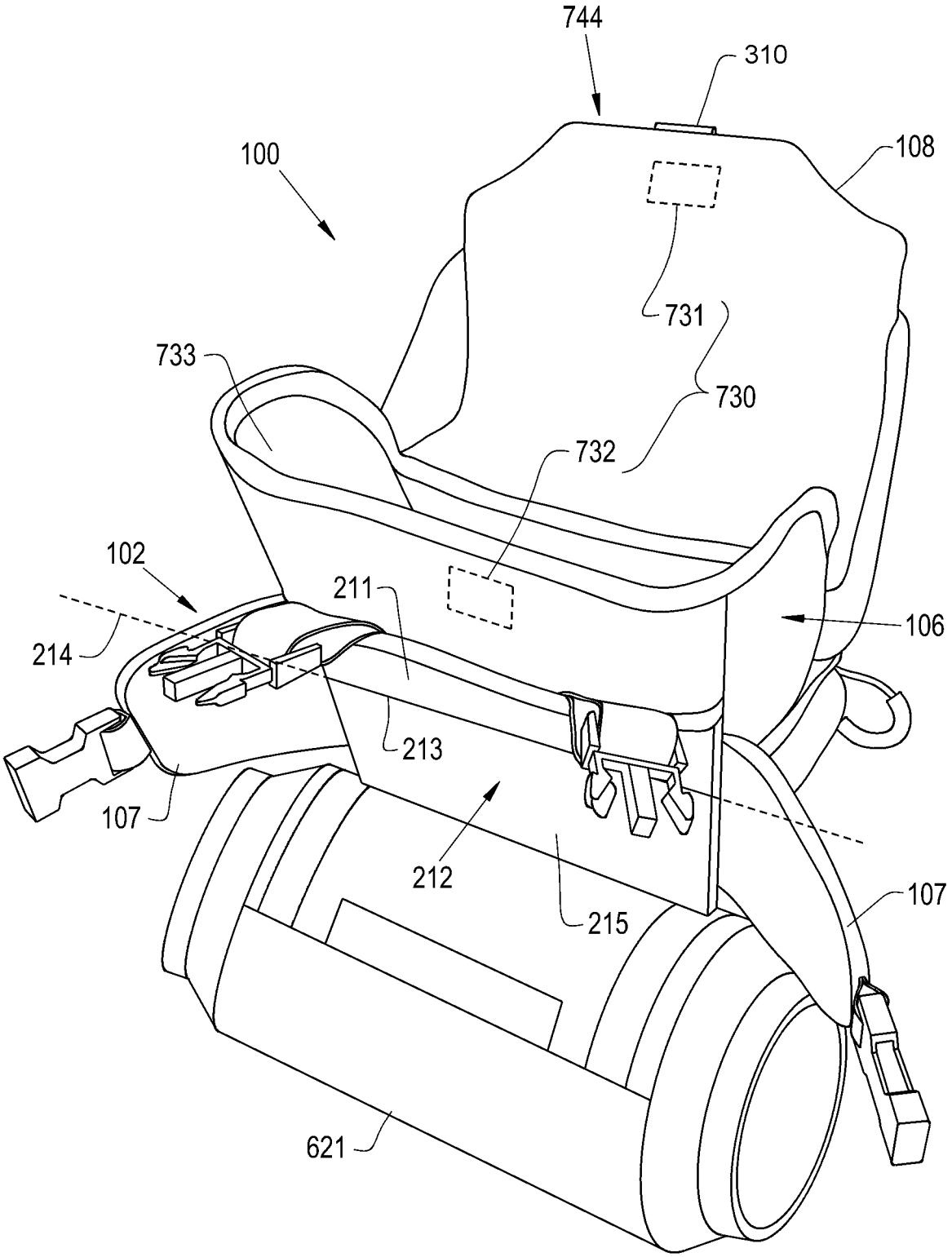
FIG. 7 is a rear perspective view of the wearable pack system of FIG. 6, less the harness device and the side pouches, in accordance with an exemplary embodiment of the present invention.

Referring now to FIG. 7, there is shown a rear perspective view of pack system 100, substantially similar to pack system 100 shown in FIG. 6 with handwarmer 621. However, for illustrative purposes, harness device 101 and side pouches 620 are omitted in FIG. 7 (as well as in remaining figures), though it can readily be appreciated that pack system 100 of FIGS. 7-10 can include harness device 101 and side pouches 620. Handwarmer device 621 is coupled with accessory attachment arrangement 212 of central pack 106, as described more fully below. Prior to accessory attachment arrangement 212 being securely coupled with handwarmer 621, flap 215 of accessory attachment arrangement 212 can pivot about axis of rotation 214 at hinge 213. Further, lid 108 is shown to be pivoted toward the front of bino pack 102 about a fabric hinge 619, thereby exposing cavity 733 of central pack 106.

Further, bino pack 102 includes at least one magnetic latch assembly 730 associated with rear side 211. Magnetic latch assembly 730 serves to releasably secure lid 108 to rear side 211. More specifically, magnetic latch assembly 730 includes first member 731 and second member 732. First member 731 is carried by lid 108, second member 732 is carried by rear side 211, first member 731 and second member 732 together being configured for being selectively magnetically coupled and decoupled relative to one another. At least one of first member 731 and second member 732 is a magnet which is magnetically attracted to the other of first member 731 and second member 732. Though at least one of members 731, 732 must be magnetic, the other of members 731, 732 may be another magnet or a metallic plate to which the magnet member of members 731, 732 is magnetically attracted. Members 731, 732 can be shaped in any suitable manner, including but not limited to a square, a rectangle, a circle, or the like. Each of members 731, 732 can be positioned internal or external to a fabric of lid 108 and rear side 211 (that is, a portion of rear side 211 which is not formed by lid 108), each of members 731, 732 being shown in FIG. 7 to be internally situated. Further, user can open lid 108 by lifting on tab 310 to pivot lid 108 forward (thereby releasing the magnetic coupling between members 731, 732), and can close lid 108 over cavity 733 by rotating lid 108 back so that members 731, 732 are magnetically attached to one another. By having magnetic latch assembly 730 at rear of central pack 106 and thus relatively closer to user's body, lid 108 is less likely to become inadvertently opened (such as by way of lid 108 becoming snagged on a tree branch), which could result in the unfortunate circumstance of an expensive pair of binoculars spilling out of cavity 733 and onto the ground. Thus, magnetic latch assembly 730, with respect to both its members 731, 732, is at rear side 211 when lid 108 is in closed position 645, while, member 732 always is at rear side 211.

Referring now to FIG. 8, there is shown a rear perspective view of pack system 100 of FIG. 7, with lid 108 closed and with bino pack 102 rotated 180° (upside down) relative to FIG. 7. In FIG. 8, flap 215 is pivoted open about axis of rotation 214 relative to rear side 211, as indicated by directional arrow 817, and a portion 822 of handwarmer 621 is attached to flap 215, as explained below. More specifically, accessory attachment arrangement 212 includes a first panel 816 and a second panel 215 (which is flap 215). First panel 816 and second panel 215 form a hook and loop fastener arrangement, also known as VELCRO® (all hook and loop arrangements and/or panels herein are understood to be a form of fasteners). As such, first panel 816 can form either of the hook panel or the loop panel, and second panel 215 can form the other of the hook panel and the loop panel. For purposes of discussion herein, it is assumed that first panel 816 forms the hook panel, and second panel 215 forms the loop panel. Panels 816, 215, being mating hook and loop panels, are configured to selectively and releasably directly couple with one another, when one or more accessory devices (such as handwarmer 621, pouch 925, and MOLLE panel device 926) are not otherwise coupled with accessory attachment arrangement 212 and thereby sandwiched between panels 816, 215. To detach panel 215 from panel 816, a user pulls panel 215 apart from panel 816 in the direction of arrow 817. Hook panel 816 can be fixedly attached to rear side 211, such as by way of sewing or stitching. Hook panel 816 can, for example, include a substrate to which a plurality of hooks are attached thereto. Similarly, loop panel 215 can include a substrate to which a plurality of loops are attached thereto. Together, panels 816, 215 are configured for selectively, matingly, and removably coupling with a hook and loop mechanisms 822, 927, 928 of at least one accessory device 620, 925, 926, pack system 100 optionally including one or more accessory devices (such as accessory devices 620, 925, 926) attached to bino pack 102 by way of accessory attachment arrangement 212.

Handwarmer 621 thus includes hook and loop mechanism 822. Hook and loop mechanism 822 includes or forms a flap attached to a main body of the handwarmer (the portion that warms a user's hands), such as by way of sewing or stitching. Mechanism 822 includes both a loop panel 823 and a hook panel 824 (that is, hook and loops of VELCRO®), panels 823, 824 being positioned back-to-back relative to one another. For illustrative purposes, a top right corner (in the view of FIG. 8) of mechanism 822 is bent back into the foreground of FIG. 8 in order to be able to see a portion of hook panel 824, it being understood that hook panel 824 is sized and shaped to mirror loop panel 823. Optionally, mechanism 822 can: (1) have a single substrate with opposing sides, the loops of panel 823 being attached to one side to form panel 823, the hooks of panel 824 being attached to the other side to form panel 824; (2) include two substrates, one substrate being part of loop panel 823, the other substrate being part of hook panel 824, and both substrates being attached to one another in any suitable manner; or (3) include two substrates like in alternative (2) but include an additional layer between the substrates to which the substrates are attached in any suitable manner. These alternatives are provided only by way of example and are not intended to exclude other structures forming mechanism 822. To attach handwarmer 621 to central pack 106, panels 816, 215 sandwich mechanism 822 therebetween. In so doing, loop panel 823 of mechanism 822 matingly and removably couples with hook panel 816 of arrangement 212, and hook panel 824 of mechanism 822 matingly and removably couples with loop panel 215 of arrangement 212.

Figure 9:
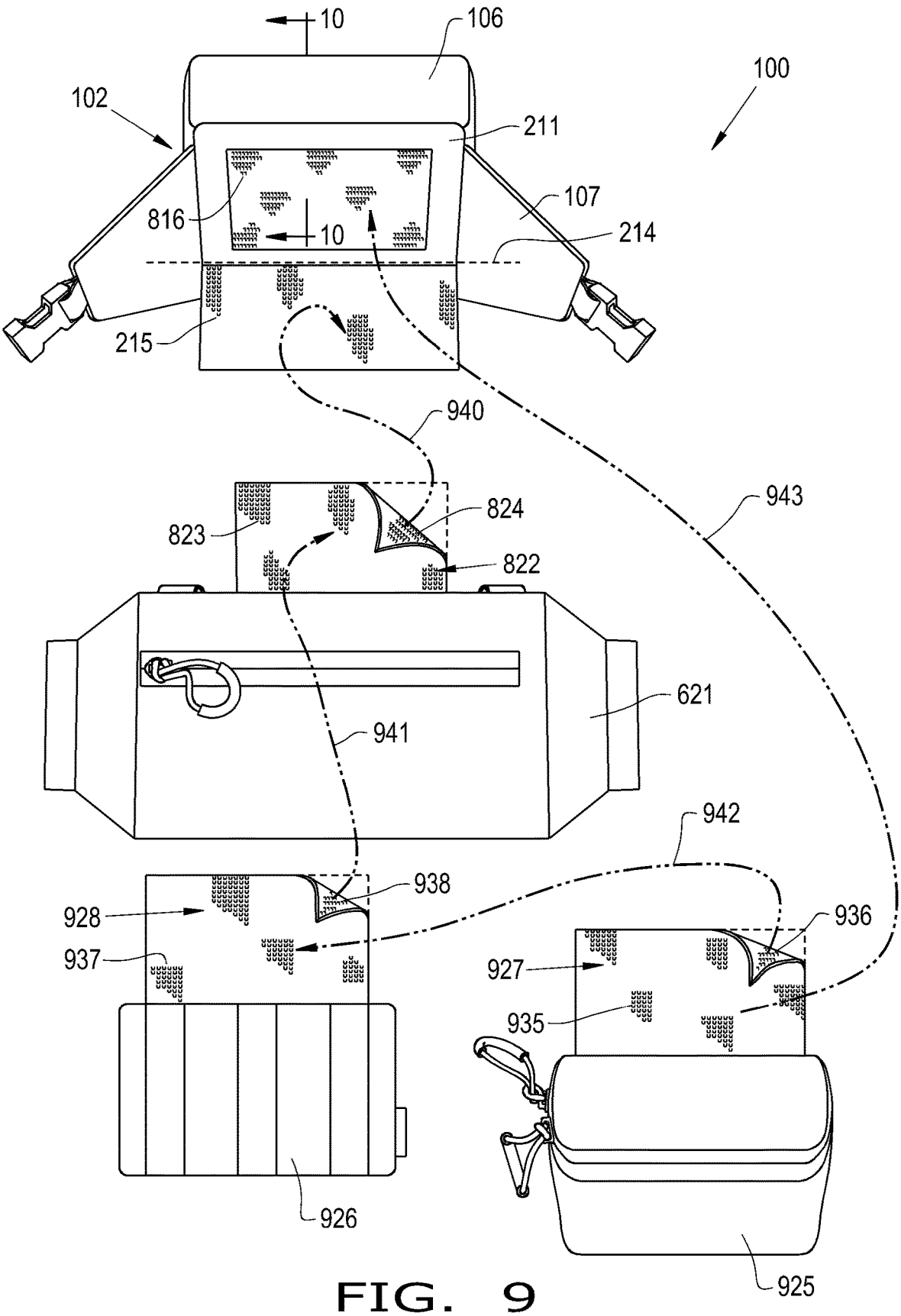
FIG. 9 is a rear perspective view of yet another exemplary embodiment of the wearable pack system 100 of FIG. 1, with three accessory devices exploded from the chest pack, in accordance with an exemplary embodiment of the present invention.

Referring now to FIG. 9, there is shown a rear perspective view of pack system 100 as in FIG. 8 Bino pack 102 being upside down), but with handwarmer 621—and two additional accessory devices 925, 926—exploded from bino pack 102, rendering this an additional embodiment of the present invention. The additional accessory devices 925, 926 are a pouch device 925 (which can include one or more zippers, for instance) and a MOLLE panel device 926. Each of pouch device 925 and MOLLE panel device 926 includes a hook and loop mechanism 927, 928, respectively, mechanisms 927, 928 being substantially similar to hook and loop mechanism 822 in structure and function, unless stated otherwise. Thus, pouch device mechanism 927 includes loop panel 935 and a hook panel 936, and MOLLE panel device mechanism 928 includes loop panel 937 and a hook panel 938 (loop panels 935, 937 being in the foreground in FIG. 9, hook panels 936, 938 being bent forward for illustrative purposes in order to be able to see a portion of hook panels 936, 938 in FIG. 9). One or a plurality of accessory devices (such as devices 620, 925, 926) can be attached to accessory attachment device 212 by way of their respective hook and loop mechanisms (such as mechanisms 822, 927, 928), by stacking the hook and loop mechanisms (such as mechanisms 822, 927, 928) relative to one another and sandwiching this stack of hook and loop mechanisms (such as mechanisms 822, 927, 928) between hook and loop panels 816, 215 of accessory attachment arrangement 212. For instance, though this stacking and sandwiching arrangement is shown in more detail in FIG. 10, arrows 940, 941, 942, 943 in FIG. 9 shows how this can be done. That is, arrow 940 shows that hook panel 824 of handwarmer 621 can attach directly to loop panel 215 of arrangement 212; arrow 941 shows hook panel 938 of MOLLE panel device 926 can attach directly to loop panel 823 of handwarmer 621; arrow 942 shows that hook panel 936 of pouch device 925 can attach directly to loop panel 937 of MOLLE panel device 926; and, finally, arrow 943 shows that loop panel 935 of pouch 925 can attach directly to hook panel 816 of arrangement 212.

Figure 10:
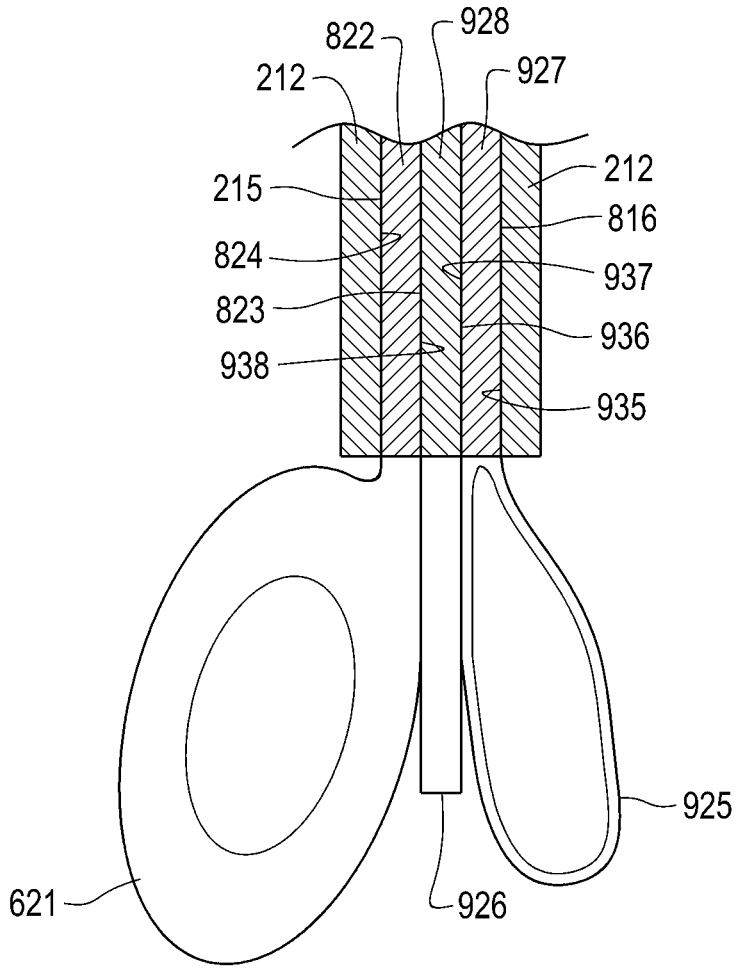
FIG. 10 is schematically a cross-sectional side view taken along line 10-10 in FIG. 9 of the wearable pack system, with portions broken away, the wearable pack system including three accessory devices attached to an accessory mounting arrangement of the chest pack device.

Referring now to FIG. 10, there is shown schematically a cross-sectional side view taken along line 10-10 in FIG. 9, with portions broken away (for example, showing only a partial thickness of system 100), and including portions of the three accessory devices 621, 925, 926 now attached to accessory mounting arrangement 212. More specifically, loop panel 215 of accessory mounting arrangement 212 of bino pack 102 is attached directly to hook panel 824 of mechanism 822 of handwarmer 621. Loop panel 823 of mechanism 822 of handwarmer 621 is attached directly to hook panel 938 of mechanism 928 of MOLLE panel device 926. Loop panel 937 of mechanism 928 of MOLLE panel device 926 is attached directly to hook panel 936 of mechanism 927 of pouch device 925. Loop panel 935 of mechanism 927 of pouch 925 is attached directly to hook panel 816 of arrangement 212 of bino pack 102.

In use, a user of system 100 can open and close lid 108 by way of magnetic latch assembly 730 in order to store any item, such as a pair of binoculars, in cavity 733 of central pack 106 of pack device 102, or to remove the binoculars therefrom. Further, user of system 100 can one or a plurality of accessory devices to pack device 102, such as side pouches 620 to side extensions 107 and/or one or more of accessory devices 621, 925, 926 to accessory attachment arrangement 212 of central pack 106. For instance, if user chooses to attach only handwarmer 621 to arrangement 212, user can attach hook panel 824 of handwarmer 621 directly to loop panel 215 of arrangement 212, and can attach loop panel 823 of handwarmer 621 directly to hook panel 816 of arrangement 212 of bino pack 102. Alternatively, if user chooses to attach each of accessory devices 621, 925, 926 to accessory attachment arrangement 212 of central pack 106, user can stack accessory devices 621, 925, 926 in layers, in any chosen order, between panels 215, 816 of accessory attachment arrangement 212. As such, hook and loop panels of accessory devices 621, 925, 926 matingly connect to one another, and outer hook and loop panels of the stacked arrangement of accessory devices 621, 925, 926 matingly connect with panels 215, 816. User can choose to use any accessory device, in any combination, and in any order, to be attached to accessory attachment arrangement 212. Further, user can quickly and easily remove any accessory device 621, 925, 926 from the stack, or rearrange them as desired. Once accessory devices 621, 925, and/or 926 are attached to arrangement 212, the hook and loop panels 215, 816, 823, 824, 935, 936, 937, 938 devices 621, 925, 926 and arrangement 212 are not visible. Further, user can wear system 100 by placing front straps 104 of harness device 101 over the user's shoulders or trapezius muscles with rear panel 103 on the upper back of user and bino pack 102 (which is connected to harness device 101) situated on or about the user's chest. User can tighten system 100 about user's body by tightening any straps 104, which can include pulling lower back straps 104—which are clipped to bino pack 102 and connected to buckles 105—forward.

Figure 11:
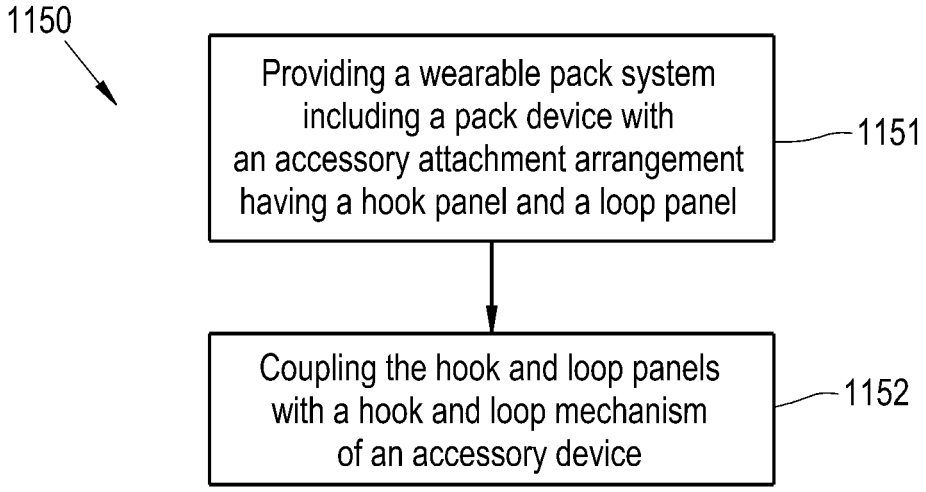
FIG. 11 is a flow diagram showing a method of using an agricultural machine system, in accordance with an exemplary embodiment of the present invention.

Referring now to FIG. 11, there is shown a flow diagram showing a method of using a wearable pack system 100. The method 1150 includes the steps of: providing 1151 the wearable pack system 100 including a support device 101 and a pack device 102 coupled with the support device 101, the pack device 102 including an accessory attachment arrangement 212 including a hook panel 816 and a loop panel 215; and coupling 1152 selectively the hook panel 816 and the loop panel 215 together with a hook and loop mechanism 822, 927, 928 of at least one accessory device 620, 925, 926. The pack device 102 is a binocular chest pack device 102, and the support device 101 is a harness device 101. The pack device 102 includes a rear side 211, the hook panel 816 and the loop panel 215 being attached to the rear side 211. The hook panel 816 or the loop panel 215 is pivotal relative to the rear side 211. The wearable pack system 100 further includes the at least one accessory device 621, 925, 926, the hook panel 816 and the loop panel 215 sandwiching therebetween the hook and loop mechanism 822, 927, 928 of the at least one accessory device 621, 925, 926, the at least one accessory device 621, 925, 926 being one of a handwarmer device 621, a pouch device 925, and a Modular Lightweight Load-carrying Equipment panel device 926. The at least one accessory device 621, 925, 926 includes a first accessory device 621, 925, 926 and a second accessory device 621, 925, 926, the hook and loop mechanism 822, 927, 928 of the first accessory device 621, 925, 926 and the hook and loop mechanism 822, 927, 928 of the second accessory device 621, 925, 926 being stacked relative to one another and sandwiched between the hook panel 816 and the loop panel 215.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wearable pack system, comprising:

a support device, the support device being a harness device and including a rear portion; and a pack device coupled with the support device, the pack device being a binocular chest pack device, the pack device including an accessory attachment arrangement including a hook panel and a loop panel, the pack device further including a rear side, the hook panel and the loop panel being attached to the rear side, the hook panel or the loop panel being pivotal relative to the rear side from a closed position by pivoting rearwardly toward a vertical plane associated with the rear portion of the harness device; and at least one accessory device including a hook and loop mechanism, the hook panel and the loop panel selectively coupling with the hook and loop mechanism of the at least one accessory device, the hook panel and the loop panel sandwiching therebetween the hook and loop mechanism of the at least one accessory device, the at least one accessory device being a handwarmer device, a pouch device, or a Modular Lightweight Load-carrying Equipment panel device.

2. The wearable pack system of claim 1, wherein the at least one accessory device is a first accessory device, the wearable pack system further including a second accessory device, the second accessory device including a hook and loop mechanism, the hook panel and the loop panel selectively coupling with the hook and loop mechanism of the second accessory device, the hook panel and the loop panel sandwiching therebetween the hook and loop mechanism of the second accessory device, the second accessory device being a handwarmer device, a pouch device, or a Modular Lightweight Load-carrying Equipment panel device, the hook and loop mechanism of the first accessory device and the hook and loop mechanism of the second accessory device being stacked relative to one another and sandwiched between the hook panel and the loop panel.

3. The wearable pack system of claim 1, wherein the pack device includes a front side, a top closure, and at least one magnetic latch assembly, the front side including a hinge by way of which the top closure is configured for pivoting between an open position and a closed position, the at least one magnetic latch assembly being at the rear side when the top closure is in the closed position.

4. A pack device of a wearable pack system including a support device which is a harness device, the support device including a rear portion, the pack device comprising:

the pack device which is configured for being coupled with the support device, the pack device being a binocular chest pack device, the pack device including an accessory attachment arrangement including a hook panel and a loop panel which together are configured for selectively coupling with a hook and loop mechanism of at least one accessory device of the wearable pack system, the pack device further including a rear side, the hook panel and the loop panel being attached to the rear side, the hook panel or the loop panel being pivotal relative to the rear side from a closed position by pivoting rearwardly toward a vertical plane associated with the rear portion of the harness device, the hook panel and the loop panel being configured for sandwiching therebetween the hook and loop mechanism of the at least one accessory device, which is a handwarmer device, a pouch device, or a Modular Lightweight Load-carrying Equipment panel device.

5. The pack device of claim 4, wherein the hook panel and the loop panel together are configured for selectively coupling with the hook and loop mechanism of the at least one accessory device which is a first accessory device, the hook panel and the loop panel together being configured for selectively coupling with a hook and loop mechanism of a second accessory device of the wearable pack system, the hook panel and the loop panel being configured for sandwiching therebetween the hook and loop mechanism of the second accessory device, the second accessory device being a handwarmer device, a pouch device, or a Modular Lightweight Load-carrying Equipment panel device, wherein the hook panel and the loop panel are configured such that the hook and loop mechanism of the first accessory device and the hook and loop mechanism of the second accessory device are stacked relative to one another and sandwiched between the hook panel and the loop panel.

6. The pack device of claim 4, wherein the pack device includes a front side, a top closure, and at least one magnetic latch assembly, the front side including a hinge by way of which the top closure is configured for pivoting between an open position and a closed position, the at least one magnetic latch assembly being at the rear side when the top closure is in the closed position.

7. A method of using a wearable pack system, the method comprising the steps of:

providing the wearable pack system including a support device, a pack device coupled with the support device, and at least one accessory device, the support device being a harness device and including a rear portion, the pack device being a binocular chest pack device, the pack device including an accessory attachment arrangement including a hook panel and a loop panel, the pack device further including a rear side, the hook panel and the loop panel being attached to the rear side, the hook panel or the loop panel being pivotal relative to the rear side from a closed position by pivoting rearwardly toward a vertical plane associated with the rear portion of the harness device; and coupling selectively the hook panel and the loop panel together with a hook and loop mechanism of at least one accessory device, the hook panel and the loop panel sandwiching therebetween the hook and loop mechanism of the at least one accessory device, the at least one accessory device being a handwarmer device, a pouch device, or a Modular Lightweight Load-carrying Equipment panel device.

8. The method of claim 7, wherein the at least one accessory device is a first accessory device, the wearable pack system further including a second accessory device, the second accessory device including a hook and loop mechanism, the hook panel and the loop panel selectively coupling with the hook and loop mechanism of the second accessory device, the hook panel and the loop panel sandwiching therebetween the hook and loop mechanism of the second accessory device, the second accessory device being a handwarmer device, a pouch device, or a Modular Lightweight Load-carrying Equipment panel device, the hook and loop mechanism of the first accessory device and the hook and loop mechanism of the second accessory device being stacked relative to one another and sandwiched between the hook panel and the loop panel.

* * * * *